United States Patent [19]

Kurikka

[11] Patent Number: 4,771,612

[45] Date of Patent: Sep. 20, 1988

[54] METHOD AND APPARATUS FOR THE UTILIZATION OF HEAT ENERGY RELEASED IN A COOLING PROCESS OF WATER

[75] Inventor: Pentti Kurikka, Espoo, Finland

[73] Assignee: Imatran Voima Oy, Helsinki, Finland

[21] Appl. No.: 8,167

[22] Filed: Jan. 29, 1987

[30] Foreign Application Priority Data

Jan. 29, 1986 [FI] Finland ..... 860430

[51] Int. Cl.[4] ..... F25D 9/00

[52] U.S. Cl. ..... 62/402; 60/682

[58] Field of Search ..... 62/401, 402, 476; 237/11; 60/682

[56] References Cited

U.S. PATENT DOCUMENTS 3,355,905 12/1967 Berhold et al. ..... 62/402

4,480,444 11/1984 Conan ..... 62/402

*Primary Examiner*—Henry A. Bennet

*Attorney, Agent, or Firm*—Birch, Stewart, Kolasch & Birch

[57] ABSTRACT

This publication describes a method and apparatus for the utilization of heat energy released in a cooling process. In accordance with the method, air used as the heat transfer medium is routed to a compressor (2) in which compressor (2) the air is compressed to a higher pressure, the compressed air is cooled to a lower temperature, the cooled air is routed to a turbine (8), where it expands to a lower pressure and cools down, and air expansion work released in the turbine (8) is used for rotating the compressor (2). In accordance with the invention, air is compressed in the compressor (2) to such a high pressure that its temperature exceeds a minimum temperature of water boiling point in normal atmospheric pressure, the high-pressure compressed air is cooled to a sufficiently low temperature, e.g., below 15° C., by means of at least one heat exchanger (4, 6) in order to prevent freezing in the turbine (8); the heated medium from the secondary circuit of the heat exchanger (4, 6) is utilized as such, e.g. as hot water, and air is routed from the turbine (8) as such, to the object to be cooled. The method allows the use of the heating medium as such for cooling purposes.

6 Claims, 3 Drawing Sheets

METHOD AND APPARATUS FOR THE UTILIZATION OF HEAT ENERGY RELEASED IN A COOLING PROCESS OF WATER

The present invention relates to a method for the utilization of heat energy released in a cooling process.

The present invention also concerns an apparatus for the implementation of the method.

Cooling equipment using ammonia or a fluorinated hydrocarbon as a heat transfer medium are commonly used where a mechanical cooling process is needed. Combined cooling and heating processes which operate in circumstances involving large temperature differentials are not encountered in practical use due to the technical limitations involved in the aforementioned cold processes.

Prior art cold processes utilize heat media, which, due to their characteristics, are generally toxic to the environment and applicable only over an extremely restricted temperature range.

If the cooling energy is to be utilized in, for instance, hot water production, a conventional heat pump must be connected in series with the prior art cooling equipment in order to achieve the required temperature (in excess of 60° C.). This kind of an arrangement makes the system complicated and impairs the specific heat consumption.

The present invention aims to overcome the disadvantages of the aforementioned technique and to achieve a completely novel type of method for the utilization of heat energy released in a cooling process.

The method is based on the utilization of the Brayton process, which is characterized by the use of air as the heat transfer medium. Its benefit is its nontoxicity as compared to conventional heat media.

The temperature level required for deep freezing is achieved in the proposed process by allowing compressed air of about 10° C. in temperature to expand in a turbine until reaching atmospheric air pressure. Depending on the air temperature, a pressure ratio of 3 is sufficient for reaching temperatures even below −50° C. The required compressed air is produced with an uncooled turbocompressor. Then, depending on the inlet air temperature, the compressed air is heated reaching temperatures of up to 200° C. Using heat exchangers, air is cooled to the inlet air temperature required by the turbine, a process which produces hot water for, e.g. heating purposes. Part of the drive power required by the compressor is obtained from a turbine connected to the same shaft and the remainder from an electric motor or the like. The total coefficient of performance (COP) in this combined cooling and heating process is in the order of 3.

An essential characterizing feature with respect to the operating feasibility of the process is that possible freezing and crashing problems of the turbine wheel blades caused by air humidity are prevented by temperature controlled turbine inlet air.

More specifically, the method in accordance with the present invention is characterized by what is stated in the characterizing part of claim 1.

Furthermore, the apparatus in accordance with the present invention is characterized by what is stated in the characterizing part of claim 5.

The invention provides appreciable benefits. Thus, the present invention provides means for producing cooling energy at an unconventionally high efficiency for deep freezing and other similar purposes. According to the proposed method, the heat medium exiting from the cooled object achieves such a high temperature level so as to allow its use in heating, production of hot water and the like.

The most important advantages of this method based on the aforementioned Brayton process are evident in the simplicity of the equipment, nontoxicity of the heat medium used, wide variation range of temperatures attainable and an appreciably high total coefficient of performance (COP).

The present invention is illustrated in the following detailed exemplifying embodiments and in accordance with the enclosed drawings.

Figure 1:
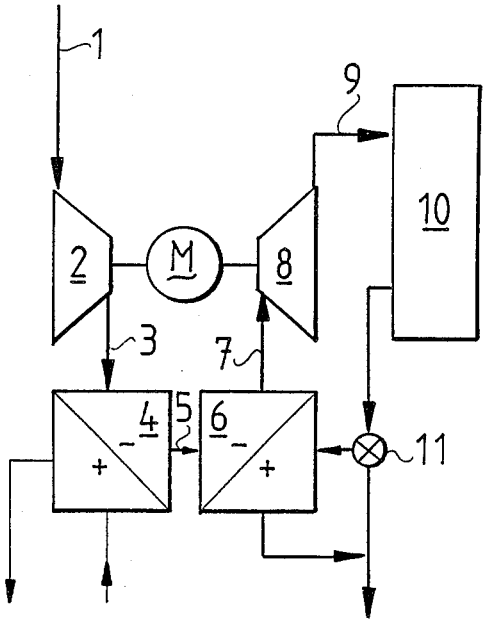
FIG. 1 illustrates partly diagrammatically the process according to the present invention.

According to FIG. 1, the apparatus comprises turbocompressor machinery driven by a motor, heat exchangers placed between the compressor and the turbine, a cold chamber or tunnel incorporated in the cooling process and equipment required for temperature controls.

In this exemplifying embodiment, the inlet air temperature of the process is about 30° C. When the air is compressed in a turbocompressor 2 at an efficiency of 82% up to a pressure of 3 bar, it reaches a temperature of 170° C. at a point 3 after the turbine. By warming the intake water from 5° C. to 60° C. in a heat exchanger 4, the air is cooled to 40° C. at a point 5. At an air mass flow of 5 kg/s, the water flow is about 2.8 kg/s. The air is cooled in a heat exchanger 6 by, for instance, the outlet air of a cold chamber 10 to 10° C. at a point 7 in order to eliminate freezing problems of the expansion process. When expanding in a turbine 8 back to the atmospheric pressure, the air is cooled to −55° C. at a point 9, after which it is routed to a cold chamber or tunnel 10. The air exiting from there at a temperature of −10° C. is used by a regulating flap valve 11 as, e.g., the inlet air of the turbine or, alternatively, for cooling any other object, for instance, in an air conditioning system.

In the exemplifying embodiment, the power required by the compressor 2 is 710 kW, of which the turbine produces 325 kW. The additional required power is provided by an electric motor M, which, for the compensation of different losses, must provide a power of about 410 kW. The available output heat power from the process of the exemplifying embodiment is 650 kW and the cooling power in the cold process is 230 kW. An additional advantage is further available from the outlet air of the cold process and of ice formed from the air condensation. The exemplifying embodiment achieves a minimum coefficient of performance (COP) of about 2.15. The process efficiency can be essentially improved if a suitable waste heat source is available for increasing the temperature of the inlet air 1.

Figure 2:
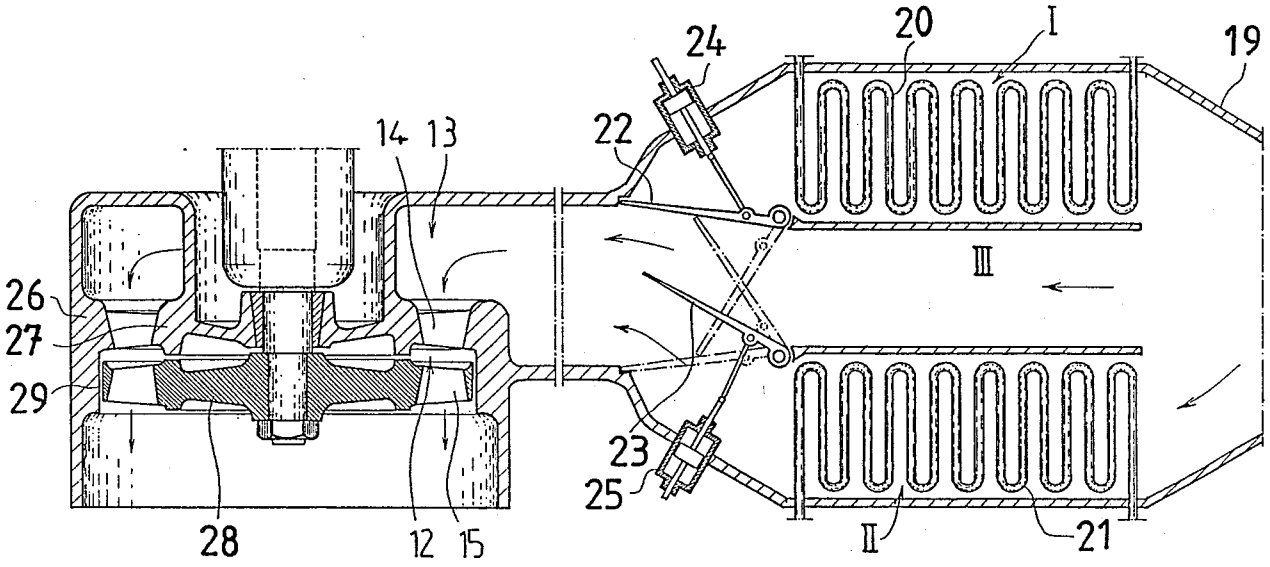
FIG. 2 illustrates the construction of an air turbine, applicable to the process according to the present invention, together with related control equipment for regulating the wet or moist inlet air flowing into the turbine.

The air turbine applicable to the process is shown in FIG. 2 comprising a turbine itself together with an apparatus by means of which the temperature of the wet or moist inlet air flow is controlled. FIG. 2 illustrates an arrangement by means of which it is possible, in principle, to construct the control system. The system 19 for controlling the inlet air is divided into three flow ducts, of which the first one (I) is provided with a heating heat exchanger (20), the second one (II) is provided with a cooling heat exchanger 21, and the third one (III) is a straight flow duct without a heat exchanger. The temperature of the inlet air is controlled by guiding the air flow partly or entirely through either one of the flow ducts I, II provided with a heat exchanger 20, 21 by regulating the control flaps by means of pneumatic, hydraulic, or electric actuating means 24, 25.

FIG. 2 shows the construction of the air turbine. The inlet air of the turbine is led into a temperature control unit 19, where the air may flow through three ducts I, II, III. The temperature of the air flow is measured after the control unit 19, in the duct 13 routed to the turbine. If the air temperature in the duct 13 is below the desired value, the control gate flap 22 is opened by means of the actuator 24, whereby part of the inlet air flow passes through the heating heat exchanger 20, thereby warming the inlet air. If the air temperature in the duct 13 is above the desired value, the control gate flap 23 is opened by means of the actuator 25, whereby part of the inlet air flow passes via the cooling heat exchanger 21, thereby cooling the inlet air. Temperature control of the inlet air is based on a conventional technique.

Regarding its construction, the air turbine may be either an axial turbine, a radial turbine, or an intermediate of the same. Regarding its principle of operation, the turbine may be an action turbine or a reaction turbine or a turbine operating with a moderate reaction degree ($r=0.05 \ldots 0.45$). The turbine shown in FIGS. 2 and 3 as an example is an axial turbine operating with a moderate reaction degree.

The air turbine consists of a stator 26, whose guide wheel 27 is provided with guide vanes 14. The other part of the turbine is the rotor 28, whose runner 29 is again provided with runner vanes 15. The guide passages 16 formed between the guide vanes 14 are strongly curved in order that the relatively large subcooled water droplets contained in the air flow passing through the said vanes 14 are separated from the air flow and decomposed when they strike against the guide vanes 14 and are partly solidified or frozen or form wet snow. Adherence of ice or wet snow onto the guide vanes 14 is prevented so that the wall temperature of the vanes is above the freezing point of water, in which case snow and ice do not adhere to the warm and wet wall but glide along the wall face and are blown off along with the air flow.

Between the guide wheel 27 and the runner 29, there is a relatively large intermediate space 12 in order that the distance travelled by the air flow from the guide wheel 27 to the runner 29 should be sufficiently long. This is important in view of the operation of the air turbine because, even though the temperature of the air flow has been lowered to a level considerably below the freezing point of water after the air flow has passed through the guide passages 16, the wet snow and subcooled water droplets formed must have sufficient time to freeze before they arrive at the runner 29. Because the cooling taking place in the intermediate space results in the formation of dry snow flakes or dry particles of ice, these do not adhere to the walls of the runner 29, even though the prevailing wall temperature is lower than the freezing point of water since dry particles of ice do not adhere to a cold wall face.

The intermediate space 12 is shaped so that two annular whirls (tori) 18 are formed between the guide wheel 27 and the runner 29 to prevent formation and adherence of ice onto the turbine walls.

Figure 3:
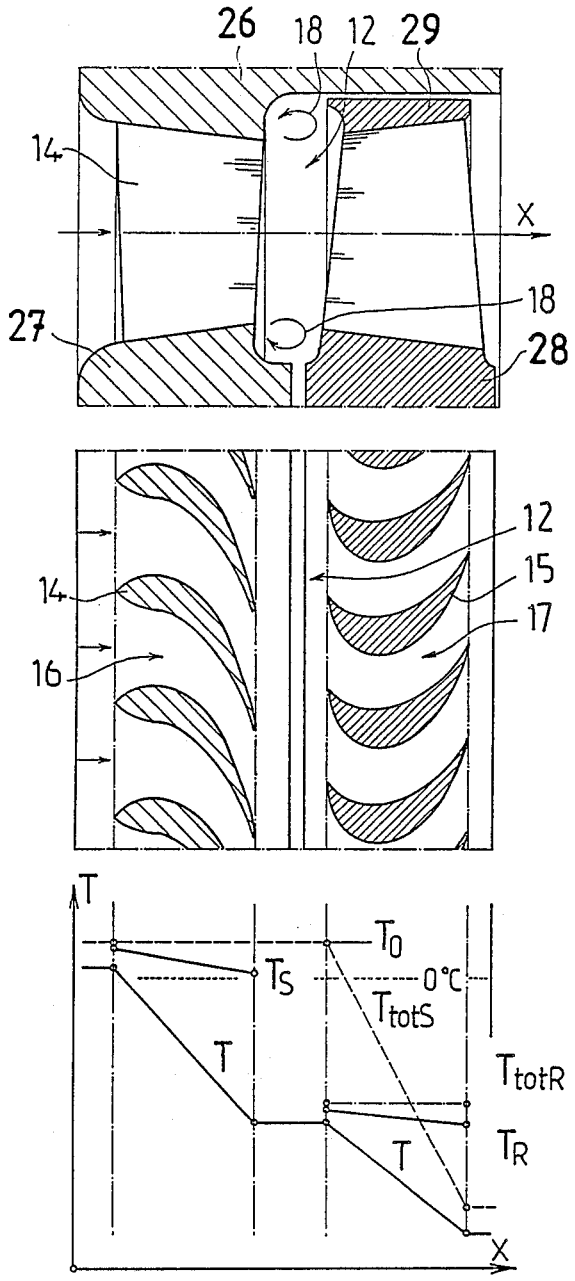
FIG. 3 illustrates a sectional view of the turbine blades and shows a diagram which illustrates the actual inlet air temperature together with the wall temperature of the turbine in the stator and in the rotor.

FIG. 3 shows the actual temperature of the air flow as well as the wall temperatures in the turbine in the stator 26 and in the rotor 28 along the sectional axis of the guide wheel and the runner. When the figure is examined, the operational idea of the invention is evident in the aim to construct an air turbine in which formation of ice is prevented within the risky temperature range of −10° C. to 0° C. and in which the contact of subcooled water droplet with turbine walls having a surface temperature below 0° C., is prevented.

The temperature of the moist inlet air, which is denoted in FIG. 3 by the line To, is adjusted by means of the control unit 19 so that it has a desired value above the freezing point of water. The expansion conditions and the reaction degree in the turbine have been chosen so that the wall temperature Ts of the turbine in all parts of the stator that are in contact with the air flow is clearly, but only slightly, above the temperature range involving a risk of freezing. Thereat the wet snow and subcooled water droplets formed in the guide passages 16 in the stator, on cooling of the moist air flow, do not adhere to the guide vanes 14 of the stator 26, and therefore no formation of ice detrimental to the air flow and dangerous for the operation of turbine takes place.

The static air temperature in the intermediate space between the guide wheel and the runner, as well as the turbine wall temperature Tr in all parts of the rotor that are in contact with the air flow, are clearly below the range involving risk of freezing so that any dry particles or ice formed do not partly melt on the wall faces, thereby permitting adherence of ice particles onto the walls.

It should be mentioned that the axial dimension of the intermediate space 12 is at least 30%, preferably about 50%, of the axial dimension of the runner blades 15, and that the air temperature before the turbine in the duct 13 is within the range of 2° to 10° C., and the temperature in the space 12 between the guide wheel and the runner is within the range of −30° to 15° C.

The stator need not be provided with guide vanes but it can also be provided with, for instance, nozzles.

In addition to a direct deep freezing in a cold chamber or tunnel, the proposed cold process is also applicable, for instance, in the cooling of an artificial ice skating rink, cooling of ammonia circulation circuits of iced water systems in dairies, and in the cooling of other equivalent closed refrigerant circulations by replacing the cold chamber 10 with a cooling radiator included in the process. The still cool outlet air from the radiator can furthermore often be utilized in the cooling of air conditioned premises or cooling of equipment and motors requiring air cooling.

Depending on the size of the machinery, the hot air exiting from the compressor can be utilized by means of heat exchangers for district heat production, for the general heating of premises, and/or production of hot water for process use and like.

When combined with the cooling of an artificial ice skating rink or the like, the district heating application facilitates during the low heat load typical for summertime, an advantageous coproduction of heat and cooling by the utilization of cheap summertime electric energy. The method may prove especially competitive when compared to a district heating boiler operating at a low partial load.

New applications for the combined cooling and heating process can be found in hot climate countries where cooling is often a necessity of life (e.g., in large building constructions, hospitals, palaces, etc.) and heat energy is required for industrial processes.

What is claimed is:

1. A method for the utilization of heat energy released in a cooling process which utilizes a compressor, a condenser in the form of heat exchange means, a turbine and an object to be cooled which comprises introducing air as a heat transfer medium into the compressor, compressing the air in the compressor to a high pressure so that its temperature exceeds a minimum temperature of the boiling point of water at atmosphere pressure, cooling the high pressure compressed air in at least one heat exchanger down to a temperature below 15° C. in order to prevent freezing in the turbine, the heated medium from the secondary circuit of the heat exchanger being recovered and utilized as hot water, conveying the cold air to the turbine where it is expanded to a lower pressure and cooled, said air expansion work performed in the turbine being used for rotating the compressor, and conveying the cold air from the turbine to the object to be cooled, wherein the turbine includes a stator with a guide wheel provided with guide vanes and a rotor containing a runner provided with runner vanes which define passages therebetween, said guide wheel and runner defining therebetween an intermediate space which is at least 30% of the axial extension of runner blades and the intermediate space is extended in the radial direction over the radial extension of the passages in order to generate a vortex at the inner and outer rims of the intermediate space to prevent ice formation.

2. An apparatus used for the utilization of heat energy released in a cooling process, comprising a compressor for compressing a heat transfer medium to a higher pressure, a condenser for cooling the compressed medium from the compressor, a turbine for expanding and further cooling the cooled medium to a lower pressure, and an object to be cooled and means for conveying the cooled medium to said object, wherein the condenser includes at least one heat exchanger where the heat energy of the heat transfer medium compressed in the compressor to a higher pressure is transferable to the heat medium circulating in the secondary circuit of the heat exchanger, and at least one heat exchanger in which the inlet air of the turbine is precooled with air returning from the cooled object, and wherein the turbine includes a stator with a guide wheel provided with guide vanes and a rotor containing a runner provided with runner vanes which defines passages therebetween, said guide wheel and runner defining therebetween an intermediate space which is at least 30% of the axial extension of runner blades and the intermediate space is extended in the radial direction over the radial extension of the passages in order to generate a vortex at the inner and outer rims of the intermediate space to prevent ice formation.

3. The method as claimed in claim 1, wherein the compressed air from the compressor is cooled in two cooler stages before entering the turbine.

4. The method as claimed in claim 3, wherein the air is cooled in the first stage by water circulating in the secondary circuit of a first heat exchanger and during the second stage by return air from the cooled object circulating in the secondary circuit of the second heat exchanger.

5. The method of claim 1 wherein the air in the compressor is compressed to a pressure of 2.5 to 3.3 bar.

6. The apparatus of claim 2 wherein the air in the compressor is compressed to a pressure of 2.5 to 3.3 bar.

* * * * *